United States Patent [19]

Knudsen

[11] 4,147,110

[45] Apr. 3, 1979

[54] POWER AND FREE CONVEYOR SYSTEM

[75] Inventor: Kenneth F. Knudsen, St. Clair Shores, Mich.

[73] Assignee: American Chain & Cable Company, Inc., Bridgeport, Conn.

[21] Appl. No.: 808,809

[22] Filed: Jun. 22, 1977

[51] Int. Cl.[2] ..... B61J 3/04

[52] U.S. Cl. ..... 104/172 S; 104/94; 104/250

[58] Field of Search ..... 104/172 R, 172 S, 172 BT, 104/94, 95, 249, 250, 251, 252, 253, 178, 170

[56] References Cited

U.S. PATENT DOCUMENTS

| | | | |
|---|---|---|---|
| 2,973,721 | 3/1961 | Waeter | 104/94 |
| 3,315,614 | 4/1967 | Braun | 104/172 BT |
| 3,477,390 | 11/1969 | Dolding | 104/251 |
| 3,523,504 | 8/1970 | Jones | 104/178 |
| 3,948,187 | 4/1976 | Moore | 104/250 |
| 4,058,064 | 11/1977 | Wilder et al. | 104/172 S |

*Primary Examiner*—Francis S. Husar

*Assistant Examiner*—Ross Weaver

*Attorney, Agent, or Firm*—Barnes, Kisselle, Raisch & Choate

[57] ABSTRACT

A power and free conveyor system comprising a power track, a power conveyor movable along the track, the conveyor having a plurality of depending pusher dogs thereon, a free track extending along the power track, and a plurality of carriers movable along the free track. Each carrier has at least one trolley with a pusher normally in the path of the depending pusher and holdback dogs. Each pusher and holdback dog is deflectable laterally into and out of the path of the pushers on the trolleys. A combined cam and stop member is provided with means for moving the cam and stop into the path of the pusher on the carrier. The cam and stop member includes a cam portion operable to depress the pusher dog and a cam portion operable to deflect the depending pusher and holdback dogs out of the normal path of the pusher. Stops are provided in advance of and to the rear of the carrier and are operable to maintain the carrier in stopped position.

32 Claims, 8 Drawing Figures

POWER AND FREE CONVEYOR SYSTEM

This invention relates to power and free conveyor systems.

BACKGROUND OF THE INVENTION

In one type of power and free conveyor system, a power track is provided with a conveyor having downwardly depending pusher and holdback dogs which are laterally deflectable. The carriers which move along the associated free track have at least one trolley with an upwardly extending pusher which may be rigid or retractable which becomes entrapped by the depending pusher and holdback dogs to move the carrier along the track. Conventionally, in order to stop the carriers, it has been necessary to move the carriers out of the path of the depending pushers or to stop the conveyor.

Among the objects of the invention are to provide a combined cam and stop member which not only stops the carrier but also deflects the depending pusher and holdback dogs laterally out of the path wherein they would normally engage the pushers on the carriers.

SUMMARY OF THE INVENTION

In accordance with the invention, the power and free conveyor system comprises a combined cam and stop member and means for moving the cam and stop member into the path of the pusher and holdback dogs on the carrier. The cam and stop member includes a cam portion operable to deflect the depending pusher and holdback dogs out of the path of the pushers and a stop portion operable to stop the pusher and, in turn, the carrier.

DESCRIPTION

Figure 1:
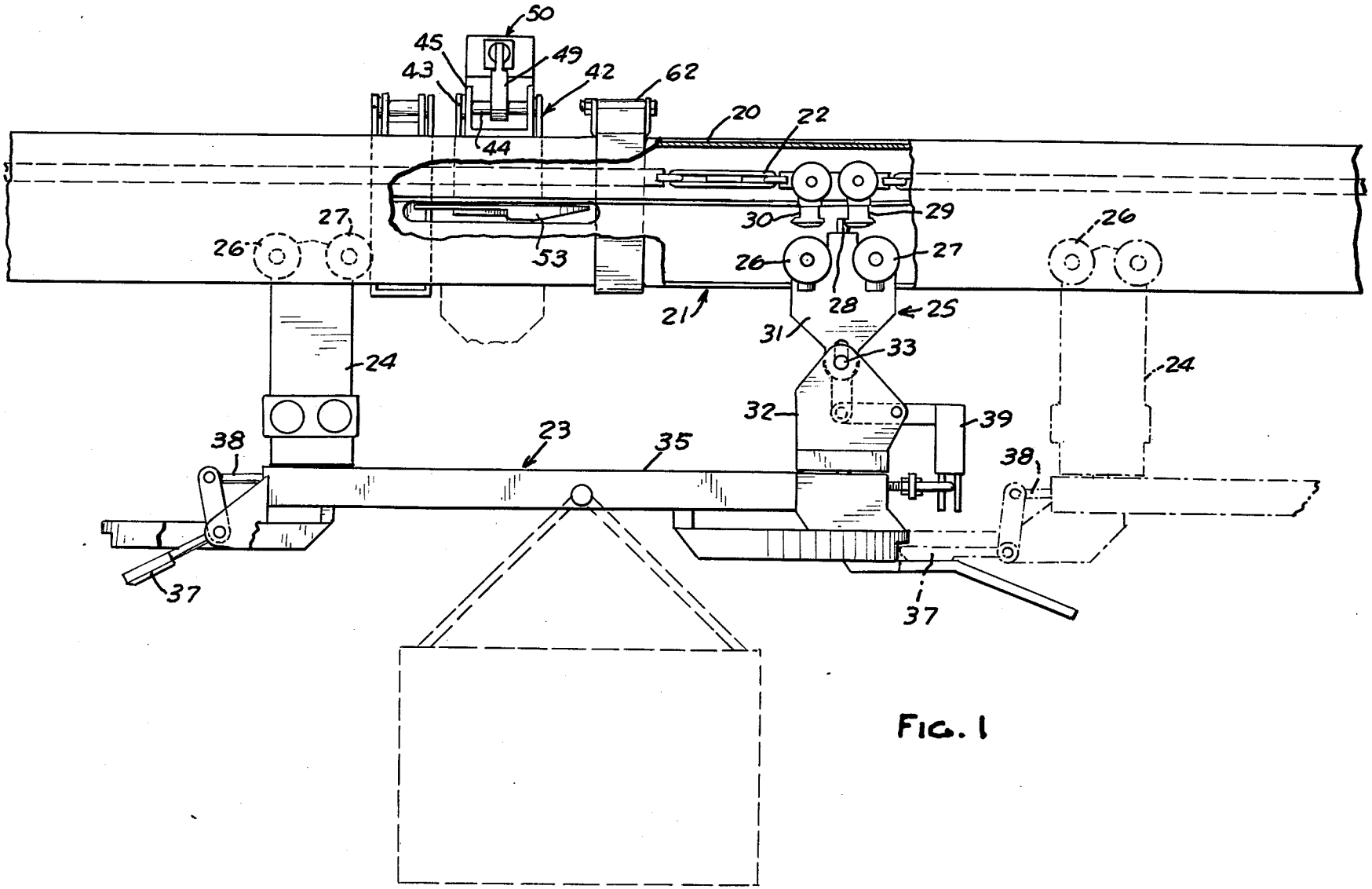
FIG. 1 is a part sectional side elevational view of a portion of a power and free conveyor system embodying the invention.

Referring to FIG. 1, the invention relates to a power and free conveyor system comprising a power or conveyor track 20 and a free or carrier track 21, herein shown as two tubular sections, one mounted within the other. A chain conveyor 22 having rollers thereon is movable along the carrier track 20. A plurality of carriers 23 are movable along the carrier track 21.

Each carrier 23 comprises a leading trolley 24 and a trailing trolley 25, each of which has spaced rollers 26, 27 that engage the carrier track 21. A pusher 28 is provided on the trailing trolley 25 and is adapted to be engaged by a pusher dog 29 on the conveyor 22 to move the carrier along the carrier track. A holdback dog 30 is provided in advance of each pusher dog 29 and serves the function of controlling the movement of the carrier since the pusher 28 is normally positioned between the holdback dog 30 and pusher dog 29. A plurality of holdback and pusher dogs 30, 29 are provided at longitudinally spaced points along the conveyor 22 and are pivoted about longitudinal axes extending in the path of movement of the conveyor, in accordance with conventional practice. If a carrier is stopped in any position, as the holdback dog 30 approaches, a cam surface thereon causes the holdback dog to be deflected by the pusher 28 bringing the pusher dog 29 into engagement with the pusher 28 so that the carrier is then advanced along the track by the conveyor.

Such a construction of power and free conveyor systems is old and well known, for example, in U.S. Pat. Nos. 3,060,866 and 3,094,943.

The rear trolley comprises an upper body portion 31 on which wheels 26, 27 are mounted and a lower body portion 32 pivoted about a horizontal axis to the upper body portion by a pin 33. A tie bar 35, in the form of an inverted U-shaped channel, is pivoted on trolleys 24, 25 about vertical axes. A rectangular paddle-shaped front bumper 37 is pivoted on the front end of tie bar 35. A pusher rod assembly 38 is pivoted to the upper ends of arms movable with front bumper 37.

The pusher rod assembly 38 is connected to an actuator 39 pivoted to lower body portion 32 and connected to pusher 28 by linkage to lower pusher 28 when bumper 37 encounters a preceding carrier or an obstacle. This construction is more completely shown in United States application Ser. No. 696,576, filed June 16, 1976, now U.S. Pat. No. 4,073,238, having a common assignee with the present application.

In operation, the carriers are moved along by entrapment of the pusher 28 between pusher and holdback dogs 29, 30. When the carrier encounters an obstacle or a preceding carrier, the bumper 37 pivots upwardly moving pusher rod assembly 38 rearwardly to pivot actuator 39, drawing the pusher 28 out of engagement with the pusher dog 29, thereby stopping the carrier.

In order to stop the carrier at a desired position along the track even though it has not encountered an obstacle or a preceding carrier, a combined cam and stop assembly 40 is provided and includes a bracket 41 mounted on the top of the free track 21. A cam lever 42 is pivoted to the bracket 41. The cam lever 42 includes a pair of arms 43 mounted on a shaft 44 that is rotatable between portions 45 of the bracket 41. The lever 42 further includes a portion 46 extending generally downwardly from the arms 43 and a portion 47 at a right angle to the portion 46.

Figure 6:
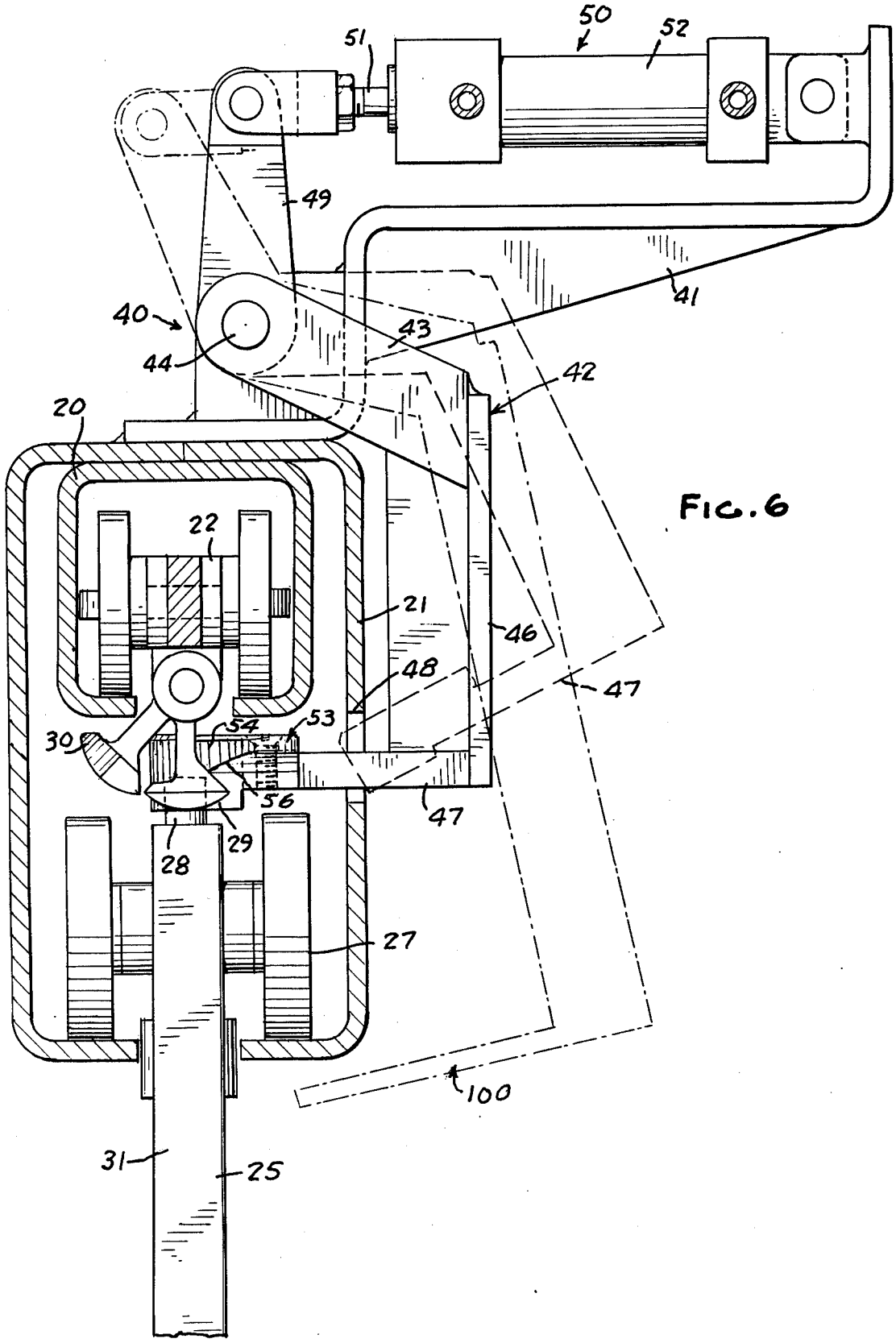
FIG. 6 is a fragmentary sectional view on an enlarged scale taken along the line 6—6 in FIG. 2.

The cam lever 42 is movable from the broken line position shown in FIG. 6 to the solid line position and back through an opening 48 in the free track wall by a mechanism which includes a link 49 fixed to shaft 44 and a fluid motor 50 which has a shaft 51 pivoted to the link and a cylinder 52 pivoted to the bracket 41.

Figures 2, 3, 4, 5:
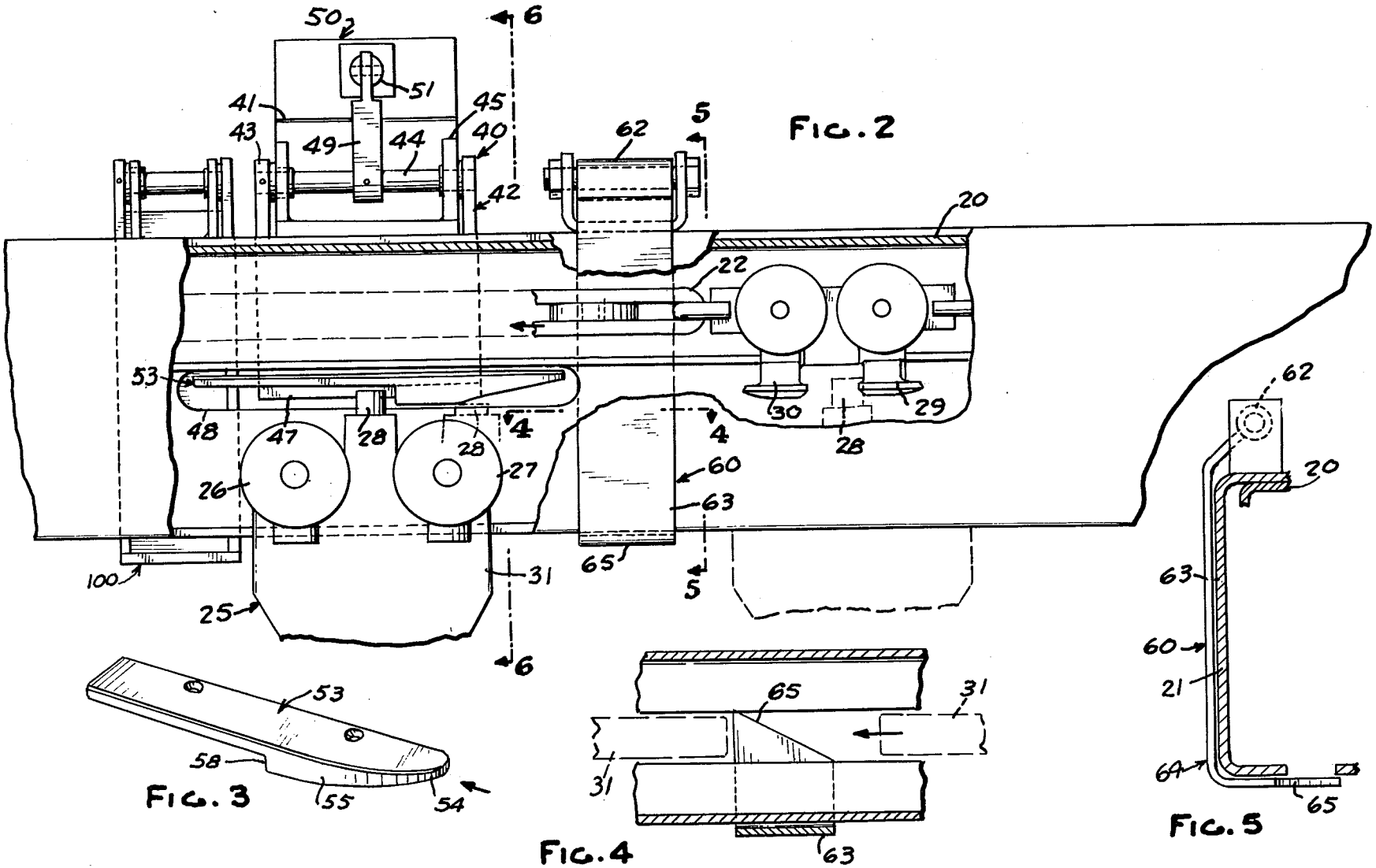
FIG. 2 is a fragmentary part sectional view on an enlarged scale of a portion of the system shown in FIG. 1.
FIG. 3 is a perspective view of a cam and stop member.
FIG. 4 is a fragmentary sectional view taken along the line 4—4 in FIG. 2.
FIG. 5 is a fragmentary sectional view taken along the line 5—5 in FIG. 2.
Figures 7, 8:
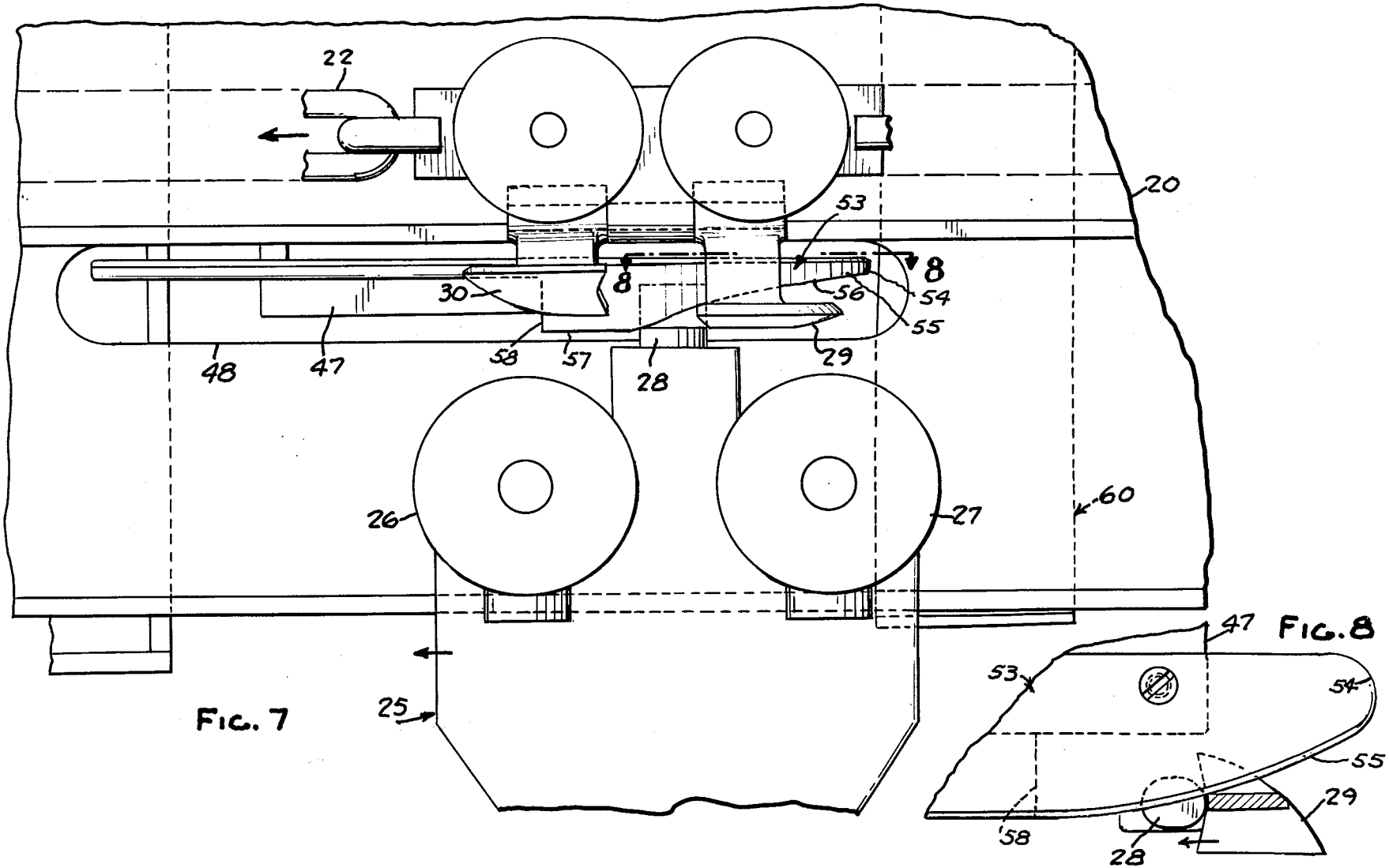
FIG. 7 is a fragmentary sectional view similar to FIG. 2, showing the parts in a different operative position.
FIG. 8 is a fragmentary sectional view taken along the line 8—8 in FIG. 7.

As shown in FIG. 3, the portion 47 of the cam lever 42 supports a cam and stop member 53. The cam and stop member 53 comprises an elongated body which in plan view (FIG. 8) has a rounded leading end 54 and a tapered side 55. The cam and stop member 53 is positioned so that when it is in the path of the conveyor dogs 29 and 30, the side 55 deflects the holdback and pusher dogs 30, 29 out of the path of a pusher 28 on the oncoming carrier. The cam and stop member 53 also includes an inclined undersurface 56 (FIG. 7) which tapers downwardly from the leading end 54 and functions to depress the pusher 28 of an oncoming carrier before the side 55 engages the pusher dog 29. Prior to this, the holdback dog 30 is cammed by the side 55. In this manner, any tendency of pusher 28 to lock the pusher dog 29 and prevent it from being laterally deflected is eliminated. The underside of cam and stop member 53 includes a flat surface 57 extending rearwardly from inclined surface 56 and terminating at a rearwardly facing notch 58. As the carrier is carried forward and the side 55 engages the dogs 30, 29, the pusher 28 rides along the inclined surface 56 and flat surface 57 until it reaches notch 58 at which time it moves upwardly under the yielding force that normally urges it upwardly. The trailing trolley 25 comes into contact with stop 100 stopping the forward motion of the carrier.

When it is desired to stop the carrier, the motor 50 is activated to move the cam and stop member 53 so that cam and stop member 53 depresses pusher 28 and deflects the dogs 29, 30 outwardly to interrupt movement of the carrier. Successive dogs 29, 30 are cammed outwardly by side 55 of cam 53.

When it is desired to release the carrier, the motor 50 is actuated to retract the cam and stop member 53 and stop 100 to the broken line position permitting the next pusher dog 29 on the conveyor 22 to engage the carrier and move it along the track, Anti-backup members 60 and stop 100 are provided in advance of and beyond the combined cam and stop assembly and each is movable into positions to engage the trolley body 31 and prevent forward or rearward movement of the trolley. Each anti-backup member 60 and stop 100 is pivoted as at 62 to the free track and includes a downwardly extending arm 63 and a transversely extending arm 64. Each member 60, 100 is counterweighted so that arm 64 is urged by gravity so that it is always in the path of the trolley bodies. An inclined surface 65 on anti-backup member 60 and stop 100 engages each successive trolley body to cam member 60 outwardly and permit the trolley bodies to normally move forwardly. Anti-backup member 60 is deflected out of the path and then back into the path of the trolley bodies so that it is in position to perform its function when the carrier is stopped. Anti-backup member 60 is used to insure that the trolley body 31 cannot rebound out of the cam and stop member 53 when the dog 28 is on the flat portion 57 of cam and stop member 53. Stop 100 operates with the cam and stop member 53 as shown on FIG. 6. When the cam and stop member 53 is moved out of the path of the dogs, a portion of cam and stop member 53 engages stop 100 to also move stop 100 out of the path of the dogs.

I claim:

1. In a power and free conveyor system, the combination comprising a power track, a power conveyor movable along said track, said conveyor having a plurality of depending pusher and holdback dogs thereon, a free track extending along said power track, a plurality of carriers movable along said free track, each said carrier having at least one trolley with a pusher normally in the path of said depending pushers, each said pusher and holdback dog being deflectable laterally independently of the other into and out of the path of the pusher on said trolleys, a combined cam and stop member, means for moving said cam and stop member into the path of said pusher on said carrier, said cam and stop member including a cam portion operable to deflect the depending pusher and holdback dogs successively out of the path of the pusher and a stop portion operable to deflect the pusher out of the path of said dogs.

2. The combination set forth in claim 1 wherein said means for moving said combined cam and stop member into and out of the path of said depending pusher and holdback dogs on the carriers comprises a cam lever pivoted adjacent the tracks and having said cam and stop member thereon, means for moving said cam lever to bring said cam and stop member into and out of operative position.

3. The combination set forth in claim 2 wherein said cam and stop member comprises a plate mounted on said cam lever and having a laterally extending surface for deflecting said depending pusher and holdback dogs laterally out of the path of the pushers on the carriers.

4. The combination set forth in claim 3 wherein said stop portion of said combined cam and stop member comprises an inclined surface extending downwardly and rearwardly beneath said cam plate, a flat surface extending rearwardly from said inclined surface and terminating in a notch into which the pusher is adapted to extend.

5. The combination set forth in claim 4 including a bracket on one of said tracks, and means pivoting said cam lever to said bracket.

6. The combination set forth in claim 5 including a link fixed to said cam lever, said means for operating said combined cam and stop member including a linear motor pivoted to said link and to said bracket.

7. The combination set forth in claim 1 including an anti-backup member pivotally mounted adjacent said combined cam and stop member.

8. The combination set forth in claim 7 wherein said anti-backup member is yieldingly urged by gravity into the path of said trolleys.

9. The combination set forth in claim 1 including an anti-backup member positioned upstream of and adjacent the combined cam and stop member and a stop member positioned downstream of and adjacent said cam and stop member.

10. The combination set forth in claim 9 wherein each said anti-backup member is yieldingly urged by gravity into the path of said trolleys.

11. The combination set forth in claim 1 wherein said combined cam and stop member includes a surface inclined downwardly and rearwardly for engaging said pusher on said trolley and moving it out of the path of said pusher dog before said dog engages said cam and stop member.

12. The combination set forth in claim 11 wherein said stop portion of said cam and stop member is positioned rearwardly of said inclined surface.

13. In a power and free conveyor system, the combination comprising a power track, a power conveyor movable along said track, said conveyor having a plurality of depending pusher and holdback dogs thereon, a free track surrounding and extending along said power track, a plurality of carriers movable along said free track, each said carrier having at least one trolley with a pusher normally in the path of said depending pusher and holdback dogs, each said pusher and holdback dog being deflectable laterally independently of the other into and out of the path of the pushers on said trolleys, a combined cam and stop member, means for mounting said cam and stop member for swinging movement into the path of said pusher on said carrier, means for moving said cam and stop member, said cam and stop member including a cam portion operable to deflect the depending pusher and holdback dogs out of the path of the pusher and a stop portion operable to deflect the pusher out of the path of the dogs.

14. The combination set forth in claim 13 wherein said means for moving said combined cam and stop member into and out of the path of said depending pushers and dogs on the carriers comprises a cam lever pivoted adjacent the tracks and having said cam and stop member thereon, means for moving said cam lever into and out of operative position.

15. The combination set forth in claim 14 wherein said cam and stop member comprises a plate mounted on said cam lever and having a laterally extending surface for deflecting said depending pusher and holdback dogs laterally out of the path of the pushers on the carriers.

16. The combination set forth in claim 15 wherein said stop portion of said cam and stop member comprises an inclined surface extending downwardly and rearwardly beneath said cam plate, a flat surface extending rearwardly from said inclined surface and terminating in a notch into which the pusher is adapted to extend.

17. The combination set forth in claim 16 wherein said cam lever comprises spaced arms, a bracket on one of said tracks, and means pivoting said arms to said bracket.

18. The combination set forth in claim 17 including a link fixed to said cam lever, said means for operating said combined cam and stop including a linear motor pivoted to said link and to said bracket.

19. The combination set forth in claim 13 including an anti-backup member pivotally mounted adjacent said combined cam and stop member.

20. The combination set forth in claim 19 wherein said anti-backup member is yieldingly urged by gravity into the path of said trolleys.

21. The combination set forth in claim 13 including an anti-backup member positioned upstream of and adjacent the combined cam and stop member and a stop member positioned downstream of and adjacent said cam and stop member.

22. The combination set forth in claim 21 wherein each said anti-backup member is yieldingly urged by gravity into the path of said trolleys.

23. The combination set forth in claim 13 wherein said combined cam and stop member includes a surface inclined downwardly and rearwardly for engaging said pusher on said trolley and moving it out of the path of said pusher dog before said dog engages said cam and stop member.

24. The combinated set forth in claim 23 wherein said stop portion of said cam and stop member is positioned rearwardly of said inclined surface.

25. For use in a power and free conveyor system comprising a power track, a power conveyor movable along said track, said conveyor having a plurality of depending pusher and holdback dogs thereon, a free track extending along said power track, a plurality of carriers movable along said free track, each said carrier having at least one trolley with a pusher normally in the path of said depending pushers, each said pusher and holdback dog being deflectable independently of the other into and out of the path of the dogs on said trolleys, a combined cam and stop member, means adapted to move said cam and stop member into the path of said pusher on said carrier, said cam and stop member including a cam portion operable to deflect the depending pusher and holdback dogs successively out of the path of the pusher and a stop portion operable to deflect the pusher out of the path of said dogs.

26. The combination set forth in claim 25 wherein said means for moving said combined cam and stop member into and out of the path of the depending pusher and holdback dogs on the carriers comprises a cam lever adapted to be pivoted adjacent the tracks and having said cam and stop member thereon, means for moving said cam lever to bring said cam and stop member into and out of operative position.

27. The combination set forth in claim 26 wherein said cam and stop member comprises a plate mounted on said cam lever and having a laterally extending surface for deflecting said depending pusher and holdback dogs laterally out of the path of the pushers on the carriers.

28. The combination set forth in claim 27 wherein said stop portion of said cam and stop member comprises an inclined surface extending downwardly and rearwardly beneath said cam plate, a flat surface extending rearwardly from said inclined surface and terminating in a notch into which the pusher is adapted to extend.

29. The combination set forth in claim 28 wherein said cam lever comprises spaced arms, a bracket adapted to be mounted on one of said tracks, and means pivoting said arms to said bracket.

30. The combination set forth in claim 29 including a link fixed to said cam lever, said means for operating said combined cam and stop member including a linear motor pivoted to said link and to said bracket.

31. The combination set forth in claim 25 wherein said cam and stop member includes a surface inclined downwardly and rearwardly for engaging said pusher on said trolley and moving it out of the path of said pusher dog before said dog engages said cam and stop member.

32. The combination set forth in claim 31 wherein said stop portion of said cam and stop member is positioned rearwardly of said inclined surface.

* * * * *